United States Patent [19]

George, Jr.

[11] 4,271,458

[45] Jun. 2, 1981

[54] DECORATIVE LIGHT TUBING

[75] Inventor: Benjamin B. George, Jr., Santa Ana, Calif.

[73] Assignee: Tivoli Industries, Inc., Santa Ana, Calif.

[21] Appl. No.: 128,349

[22] Filed: Mar. 10, 1980

[51] Int. Cl.[3] ..... F21V 15/00; F21V 23/00; F21V 31/00; F21P 1/02

[52] U.S. Cl. ..... 362/236; 362/240; 362/249; 362/252; 362/318; 362/390; 362/806

[58] Field of Search ..... 362/96, 101, 184, 236, 362/238, 240, 248, 249, 252, 318, 390, 806; 313/35, 36, 1

[56] References Cited

U.S. PATENT DOCUMENTS

| | | | |
|---|---|---|---|
| 504,890 | 9/1893 | Ohmart | 362/318 |
| 3,188,794 | 6/1965 | Johnson | 362/249 |
| 3,272,977 | 9/1966 | Holmes | 362/223 |
| 3,633,023 | 1/1972 | Castiglioni et al. | 362/249 |
| 3,714,414 | 1/1973 | Sternius | 362/249 |
| 3,755,663 | 8/1973 | George, Jr. | 362/806 |
| 3,964,194 | 6/1976 | Gugeler | 362/318 |
| 3,995,152 | 11/1976 | Chao et al. | 362/101 |
| 4,070,777 | 1/1978 | Lo Giudice | 362/101 |
| 4,107,767 | 8/1978 | Anquetin | 362/252 |
| 4,161,021 | 7/1979 | George, Jr. | 362/252 |

*Primary Examiner*—Teddy S. Gron

*Attorney, Agent, or Firm*—Nilsson, Robbins, Dalgarn, Berliner, Carson & Wurst

[57] ABSTRACT

Decorative light tubing, which has unbased miniature lamps connected in series by soldering or welding the ends of the flexible wire leads together to form parallel strings between a pair of elongated parallel wire conductors, is substantially filled with mineral oil or other clear, viscous dielectric fluid to protect the lamps and wiring against the adverse effects of vibration, shock and moisture while also enhancing the visual effect.

4 Claims, 1 Drawing Figure

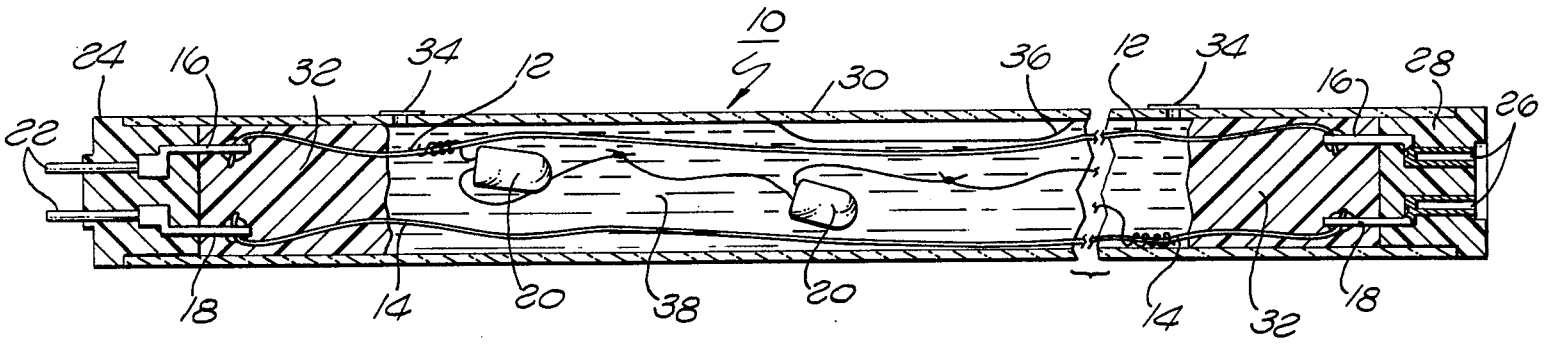
26
28
16
18
32
34
14
12
36
30
20
10
38
20
12
34
14
32
16
18
24
22

DECORATIVE LIGHT TUBING

FIELD OF THE INVENTION

The present invention relates to decorative light assemblies, and particularly to an improved form of the low voltage light tubing disclosed in U.S. Pat. No. 3,755,663 issued Aug. 28, 1973.

BACKGROUND OF THE INVENTION

Low voltage light tubing of the type described in the aforementioned patent has been widely used for safety and decorative purposes in hotels, restaurants, dance facilities, amusement parks and residences. In recent years, outdoor applications of such light tubing has increased, particularly at amusement parks to decorate roller coaster tracks and other thrill rides, where considerable vibration and shock forces are encountered, along with rain, wind, humidity, and temperature extremes.

Normally the low voltage miniature lamps, which are of the T-1 or "175" type commonly used for aircraft instrument panel illumination in small indicator displays such as red warning lights and the like, have an extremely long operating life. At the recommended six volts, these lamps consume less than one watt of power and have a rated operating life of more than 10,000 hours. Thus the lamps practically never burn out so the tubing seldom needs replacement under ordinary circumstances. However, the tubing used at amusement parks and in similar outdoor applications was found to require much more frequent repair or replacement. Apparently vibration and shock caused the lamps and connecting wires to move around within the tube rubbing against one another thus scraping off the insulative coating on the connecting wires to produce a short circuit. Also the thin wire leads on the lamps and the weld or solder connections on the ends would sometimes break. Where the tubing was placed underwater or exposed to rain, humidity and sudden temperature variations, moisture might enter the tubes causing corrosion of the wire leads or short-circuiting. In other instances, because the lamp filaments themselves become somewhat brittle with age, vibration and shock forces banging the lamps against the tube walls would break the filament.

BRIEF SUMMARY OF THE INVENTION

In accordance with a preferred embodiment, the adverse effects of vibration, shock and moisture in reducing the operating life of such low voltage tubing is minimized by substantially filling the tube with a clear mineral oil or other viscous dielectric fluid. The mineral oil buoyantly supports the individual lamps to cushion them against vibration and shock, and its viscosity impedes movement of the components to avoid their banging against one another while lubricating sliding contact between the wires so that the insulative coating is not rubbed off. Moreover, the mineral oil prevents moisture from entering the tube and forms a protective coating over the wire leads to prevent corrosion.

In the preferred embodiment, the tubing and its internal components are assembled essentially as described in the aforementioned patent, except that the dual pin connectors at either end are held in place by a plug of sealant, such as silicone caulk or other suitable adhesive that fills the ends of the tube. After curing a small hole is drilled in each end through the tube wall inward of the sealant plug to permit introduction of the mineral oil, preferably by submerging one end in the oil and applying a vacuum to the hole at the other end to draw the oil upwards into the tube. The tube is filled leaving a small bubble of air to provide relief from pressure changes caused by ambient temperature variations, and the holes are then sealed with small patches of unplasticized vinyl film held in place with a suitable adhesive.

BRIEF DESCRIPTION OF THE DRAWING

The drawing shows a fragmented cross-sectional view of both end sections of a preferred embodiment of the improved low voltage light tubing in accordance with the invention.

DETAILED DESCRIPTION

As shown in the figure, the preferred embodiment of the improved low voltage light tubing 10 includes a pair of relatively stiff insulated wires 12 and 14, preferably a light gauge hookup wire having a lacquer or other insulative coating that melts or boils off when soldered or welded, coupled at each end to a respective dual pin connector terminal 16 and 18 by soldering or welding. One or more strings of low voltage unbased lamps 20 are connected between the wires 12 and 14 to provide a substantially continuous nonoverlapping series of these lamp strings along the entire tubing length. As set forth in the aforementioned patent, the lampstrings are formed by soldering or preferably welding the flexible wire leads from the bulbs 20 together at their ends, with the final lead at the end of each substring being soldered or welded to the heavier insulated wires 12 and 14. The end connector terminals 16 and 18 at one end are coupled to a pair of protruding metal pins 22 that extend through a cylindrical plastic cap 24 to form a standard male dual pin or "bi-pin" connector. At the other end, the end terminals 16 and 18 are coupled to a pair of recessed metal sleeve receptacles 26 embedded within a cylindrical plastic cap 28 to form a standard female dual pin connector.

The plastic end caps 24 and 28 have a cylindrical inner portion that matches the interior diameter of the transparent tubing 30, which is preferably a flexible clear acrylic plastic that is heat deformable as described in the aforementioned patent. The outer ends of the plugs 24 and 28 are each provided with a narrow flange that abuts against the annular end surfaces of the tubing 30 and extends radially outward to match the outer tube diameter. The assembled light string, which has the lamps 20 connected in strings between the heavier insulated wires 12 and 14, is inserted into the tube 30, and the opposite ends of the wires 12 and 14 protruding from both ends of the tube are then connected to the respective end terminals 16 and 18. The ends of the tube 30 are filled with a slug of suitable plastic sealant 32, such as silicone caulk or two-part resin adhesive known as "polysulphide", and the end plugs 24 and 28 are inserted to push the adhesive slug ahead of them forming a fluid-type seal while compressing the lengths of the wires 12 and 14.

After the sealant plug has set and hardened a small diameter drill is used to open small holes 34 through the tubing wall on one side just inward of those sealant plugs 32. One end of the tube 30 is then immersed in a mineral oil bath so that the hole 34 at that end is covered, and a vacuum force, such as might be obtained with an appropriate fitting from an ordinary vacuum cleaner, is applied to the hole 34 at the other end to draw the mineral oil into the tube. Application of the vacuum is continued until the mineral oil nears the level of the upper hole 34 so that it substantially fills the entire interior leaving only a small bubble 36 needed to accommodate interior pressure changes due to any temperature variations. After filling, the holes 34 may be sealed with a small patch of unplasticized vinyl film held in place with a suitable adhesive, such as ethylene dichloride or simply filled with a spot of sealant. The unplasticized film or sealant should be resistant to ultraviolet radiation in the same manner as the tube 30 to avoid their becoming brittle from exposure to sunlight.

With the mineral oil or other viscous dielectric fluid 38 sealed in the tubes, the lamps 20 are buoyantly supported within the tubing material to prevent their being bounced around by vibration and shock forces. The viscous oil impedes movement of the lamp bulb 20 and wiring components so that they are not banged together by shock and vibration, ans also lubricates the surface of the insulated wires 12 and 14 to prevent the insulative coating from being rubbed off. Thus the lamp filaments that become brittle with age are not broken by shock from the lamp striking the tube wall, breaking off solder wiring connections due to flexing is eliminated, and short circuits from loss of insulation on the wires 12 and 14 are prevented. Finally, the oil 35 filling the tube 30 excludes entry of moisture into the tube and coats the uninsulated lamp leads and connections to prevent corrosion.

Not only does the mineral oil 38 prolong the useful life of the tubing under such conditions, but also improves the overall visual effect in making the light from the individual lamps 20 appear brighter and more concentrated. This is most probably due to the fact that mineral oil possesses a higher index of refraction than air, thus more closely matching that of the vinyl tube walls 20 to reduce reflection from the interior surfaces.

It should be understood that clear mineral oil is preferred, but that other clear viscous liquids, such as glycerine, might also be used in certain applications. However, mineral oil has a relatively low cost and possesses excellent dielectric, lubricating and viscous damping properties.

I claim:

1. An improved low voltage decorative tubing wherein strings of miniature unbased lamps are connected in parallel between a pair of spaced electrical wire conductors within a hollow transparent tube, the improvement comprising:

a viscous dielectric liquid substantially filling the interior of the tube; and, means for forming a fluid type seal at opposite ends of the tube to prevent the escape of said liquid.

2. The improved low voltage light tubing of claim 1 wherein:

the liquid is a clear oil for lubricating sliding contact between the lamps and wires within the tube.

3. The improved low voltage light tubing of claim 2 wherein:

the clear oil liquid substantially filling the tube is mineral oil.

4. The improved low voltage light tubing of claim 1 wherein:

the liquid substantially fills the interior of the tube leaving a small air bubble to accommodate pressure changes caused by ambient temperature variations.

* * * * *